US005511252A

United States Patent [19]

Kreemer

[11] Patent Number: 5,511,252

[45] Date of Patent: Apr. 30, 1996

[54] TOILET SEAT LIFTING HANDLE HAVING A SANITARY CAVITY

[75] Inventor: Gary A. Kreemer, Pickerington, Ohio

[73] Assignee: The Sanilift Company, Ltd., Pickerington, Ohio

[21] Appl. No.: 372,224

[22] Filed: Jan. 13, 1995

[51] Int. Cl.[6] ..... A47K 13/10

[52] U.S. Cl. ..... 4/246.1

[58] Field of Search ..... 4/246.1

[56] References Cited

U.S. PATENT DOCUMENTS

| | | | |
|---|---|---|---|
| D. 273,128 | 3/1984 | Roddick | D23/71 |
| D. 288,471 | 2/1987 | Gladstone | D23/71 |
| D. 296,658 | 7/1988 | Mead et al. | D8/305 |
| D. 309,091 | 7/1990 | Shepard | D8/305 |
| D. 325,510 | 4/1992 | Slye | D8/307 |
| D. 326,599 | 6/1992 | Callahan | D8/307 |
| D. 329,187 | 9/1992 | Sorersen | D8/307 |
| 1,999,555 | 1/1934 | Adams | 4/251 |
| 2,236,576 | 12/1939 | Loebner | 4/251 |
| 2,251,770 | 8/1941 | Warner | 4/251 |
| 2,473,082 | 6/1949 | Warner | 4/251 |
| 2,758,315 | 8/1956 | Hylton | 4/251 |
| 3,191,193 | 6/1965 | Bogenberger | 4/251 |
| 3,717,884 | 2/1973 | Mantooth | 4/237 |
| 3,783,455 | 1/1974 | Vanderbrook | 4/1 |
| 3,935,601 | 2/1976 | Hermann | 4/251 |
| 4,129,907 | 12/1978 | Vaughan et al. | 4/251 |
| 4,574,401 | 3/1986 | Nakajima | 4/251 |
| 4,742,582 | 5/1988 | Giallourakis | 4/251 |
| 4,805,246 | 2/1989 | DeVargas et al. | 4/251 |
| 4,850,062 | 7/1989 | Gibson et al. | 4/251 |
| 4,875,251 | 10/1989 | Hazard | 16/111 R |
| 5,037,272 | 7/1991 | Goodman | 16/114 |
| 5,065,460 | 11/1991 | Currin | 4/246.1 |
| 5,375,267 | 12/1994 | Davis | 4/246.1 |

*Primary Examiner*—Charles E. Phillips
*Attorney, Agent, or Firm*—Ronald W. Kock

[57] ABSTRACT

A toilet seat lifting handle assembly having a sanitary cavity with a finger opening facing away from the toilet bowl. The handle assembly includes a bracket permanently mounted to the underside of the toilet seat and a handle removably attached to the bracket. Removable attachment does not require the use of tools. A dovetail engagement between bracket and handle enables the handle to slide out of the bracket for sanitization purposes, yet remain affixed thereto in the presence of typical toilet seat lifting or lowering forces. The handle also breaks away from the bracket without damage to the handle or bracket when the handle is exposed to a downwardly directed blow when the seat is in a substantially horizontal position.

9 Claims, 2 Drawing Sheets

TOILET SEAT LIFTING HANDLE HAVING A SANITARY CAVITY

FIELD OF THE INVENTION

The present invention relates to devices attachable to toilet seats for lifting the seats, and more particularly to lifting handles which are removable for sanitization.

BACKGROUND OF THE INVENTION

Devices for manually lifting toilet seats are old in the art. Their intent is to enable a person to lift or lower a toilet seat without having to touch the seat itself. It is desirable to avoid touching a toilet seat, which may have been contaminated by splash and/or aerosolized bacteria from the toilet bowl during previous uses. The underside of a toilet seat is the side which is normally contacted by one's fingers when lifting the seat. The underside is not readily visible when the seat is in its down or horizontal position. It is the underside of the toilet seat which may be particularly susceptible to contamination.

Males are mostly responsible for lifting toilet seats for the purpose of urinating while standing. When a seat is lifted to the vertical or upright position, the seat surface upon which one sits is somewhat protected from splash generated by urination into the bowl. However, the underside of the toilet seat is exposed to such splash. Furthermore, when a toilet is flushed the seat and lid are often in their horizontal positions. The seat is separated from the toilet bowl by rubber or plastic bumper pads. These relatively thick pads are intended to absorb impact when the hinged seat is accidentally dropped onto the ceramic bowl rim. When the seat is in its horizontal position and flushing occurs, it is well known that bacteria laden aerosol from the toilet bowl is expelled outwardly from between the seat and bowl, coating the underside of the seat with contamination.

Toilet seat lifting handles typically extend laterally from the underside of a toilet seat at a location where they do not interfere with a person sitting on the seat. Many prior art handles are permanently attached to the seat. When permanently attached, a handle is almost as likely as the seat to become contaminated. Prior art handles are flat, spherical, and curved. Some have shields to minimize contamination from downwardly directed splash, which may occur when the toilet seat is in its horizontal position.

Missing in the prior art is a handle which is designed to protect the lifting surface of the handle from contamination by an upwardly directed splash, which may occur when the toilet seat is in its upright position, and from aerosolized bacteria created by flushing. In order to minimize contamination from splashes and aerosolized bacteria throughout the range of toilet seat positions, it is necessary to provide a seat lifting surface for one's fingers which is shielded top, bottom, and sides.

Even a toilet seat lifting handle which has a sanitary lifting surface requires periodic sanitization of the handle because of urination accidents or because unclean fingers have contaminated the sanitary surface. Although at least one prior art handle is removable for sanitization, tools are required to remove it. Frequency of sanitization is questionable when tools are required.

OBJECT OF THE INVENTION

In light of the above, an object of the present invention is to provide a toilet seat lifting handle which has a sanitary cavity for finger contact, the opening of which faces away from the toilet bowl regardless of the position of the toilet seat.

Another object of the present invention is to provide a toilet seat lifting handle which may be easily removed from the seat, without the use of tools, for periodic sanitization.

Yet another object of the present invention is to provide a toilet seat lifting handle which is molded of plastic and which has an attractive outer shape having smooth, rounded edges to avoid snagging clothing, causing leg abrasion, or causing difficulty with sanitization.

Still another object of the present invention is to provide a toilet seat lifting handle which will break away from its mounting bracket, without damage to the handle or to the bracket, if the handle sustains a downward blow while the seat is in a horizontal position. The breakaway feature is also intended to provide some degree of child safety in the event a child falls against the handle.

SUMMARY OF THE INVENTION

In one preferred aspect of the present invention, a handle assembly for lifting a toilet seat hinged to a toilet bowl comprises a means for fastening a handle to the toilet seat. It also comprises a seat-lifting handle. The handle has an exterior surface surrounding an inner surface. The exterior surface has a finger opening communicating with the inner surface. The finger opening faces outwardly from the toilet bowl when the toilet seat is in a substantially horizontal position. The finger opening is accessed by at least one of a user's fingers to lift and lower the toilet seat by pressing against the inner surface of the handle. The inner surface is shielded by the exterior surface from splashes created when one urinates into the toilet bowl and from aerosolized bacteria expelled from the toilet bowl when the toilet bowl is flushed.

The means for fastening the handle to a toilet seat may be a bracket permanently fastened to the toilet seat. Such a bracket has means for removable attachment of the handle, so that the handle may be removed from the bracket in order to sanitize the exterior and inner surfaces. Alternatively, the means for fastening may comprise direct connection of the handle to the toilet seat, or molding the handle with the toilet seat.

In another aspect of the present invention, a handle assembly for lifting a toilet seat hinged to a toilet bowl comprises a bracket fastened to an underside of the toilet seat. The toilet seat has a range of positions from a substantially horizontal position to a substantially upright position. The handle assembly also comprises a handle removably attached to the bracket. The handle has an exterior surface, an inner surface, a bracket end, and a lifting end. The lifting end has an outwardly facing finger opening communicating with the inner surface of the handle. The outwardly facing finger opening is accessed by at least one of a user's fingers in order to lift and lower the toilet seat by pressing against the inner surface of the handle. The inner surface is shielded by the exterior surface from splashes when one urinates into the toilet bowl with the toilet seat located anywhere within the range of positions.

The handle and the bracket have mating dovetail-shaped surfaces so that the handle is removable from the bracket without the use of tools, yet the handle is substantially fixed to the bracket when the handle is exposed to typical forces intended to lift and lower the toilet seat. The handle also breaks away from the bracket without damage to the handle and the bracket when the handle is exposed to a downwardly directed blow when the toilet seat is in a substantially horizontal position.

In yet another aspect of the present invention, a handle assembly for lifting a toilet seat hinged to a toilet bowl comprises a handle having a lifting surface and a dovetail-shaped bracket end. The toilet seat has an underside and an annular outermost edge. Also, the handle assembly comprises a bracket fastened to the underside of the toilet seat. The bracket has a dovetail-shaped recess for mating with the bracket end such that the handle is removably attached to the bracket. The handle is easily removed without the use of tools for sanitization, yet the handle remains affixed to the bracket in the presence of typical toilet seat lifting or lowering forces.

The handle may have a concave locating surface which contacts the annular outermost edge of the toilet seat when the handle assembly is installed onto the toilet seat. The locating surface locates the bracket at the underside of the toilet seat for fastening the bracket to the seat.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements.

DETAILED DESCRIPTION OF THE INVENTION

Figure 1:
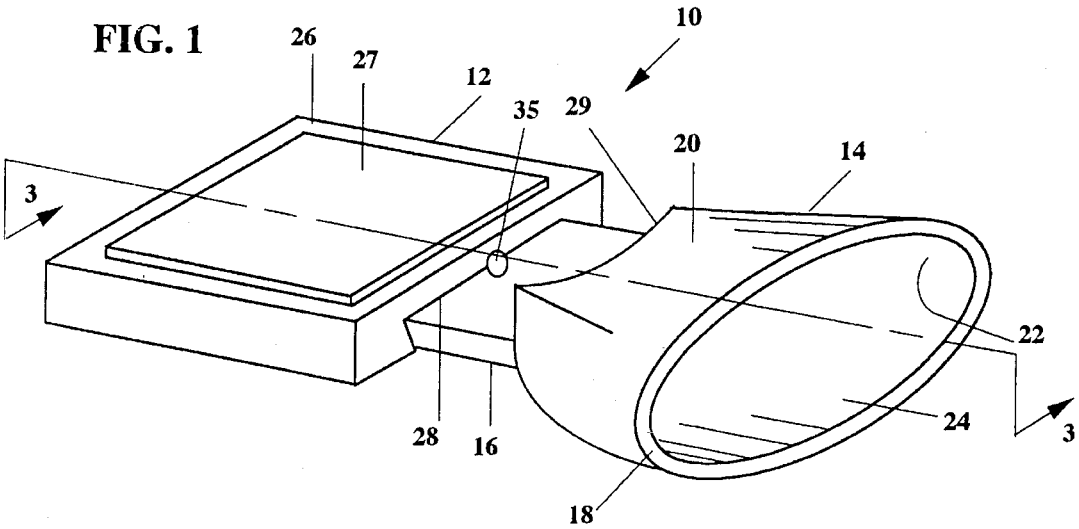
FIG. 1 is a perspective view of a toilet seat lifting handle assembly of the present invention, showing a handle having a modified paraboloid-shaped exterior surface and a dovetail-shaped mounting end, along with a mounting bracket which may be permanently connected to the underside of a toilet seat.
Figure 3:
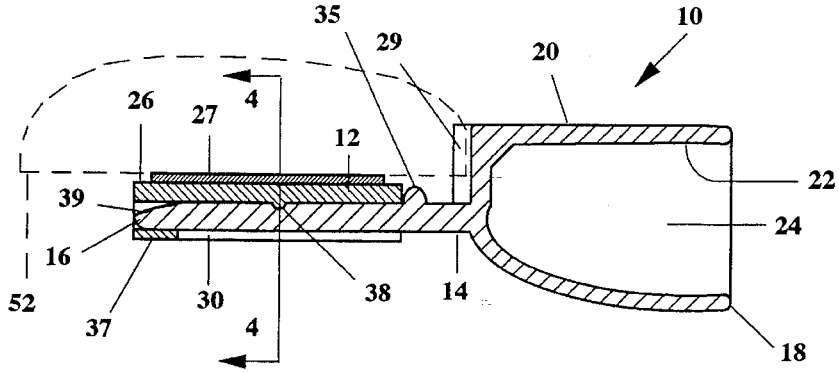
FIG. 3 is a sectioned side elevational view of the handle assembly of the present invention, taken along section lines 3—3 of FIG. 1, showing an inner surface of a sanitary cavity and the dotted outline of a toilet seat, indicating where the handle assembly is located.
Figure 4:
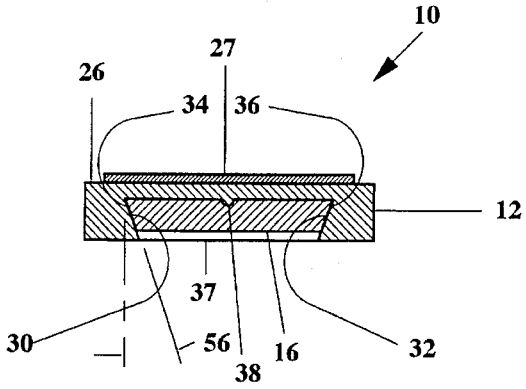
FIG. 4 is a sectioned rear elevational view thereof, taken along section line 4–4 of FIG. 3, showing the removable dovetail connection between the handle and the bracket.

Referring now to the drawings, and more particularly to FIGS. 1, 3, and 4, there is shown a preferred embodiment of the present invention, disclosing a toilet seat lifting handle assembly, generally indicated as 10. Handle assembly 10 comprises a rectangular bracket 12 and a handle 14. Handle 14 has a bracket end 16 and a lifting end 18 opposite the bracket end. Handle 14 also has a modified paraboloid-shaped exterior surface 20 which surrounds an inner surface 22. Lifting end 18 of handle 14 has an outwardly facing finger opening 24, which constitutes the only entrance to the sanitary cavity which is defined by inner surface 22.

Bracket 12 has an upper surface 26 and a recess 28. Upper surface 26 preferably has attached to it a fastening means 27 for connecting bracket 12 to a toilet seat. For example, connecting means 27 may be a piece of double-sided tape, alternatively, threaded fasteners, contact, or thermally activated adhesives could be used to fasten upper surface 26 to a toilet seat.

Recess 28 preferably has dovetail shaped surfaces 30 and 32. Bracket end 16 of handle 14 preferably mates snuggly with dovetail shaped recess 28 of bracket 12. More preferably, bracket end 16 has male dovetail shaped surfaces 34 and 36 which slide into recess 28 parallel to recess surfaces 30 and 32 such that handle 14 is removable from bracket 12 by sliding it along an axis parallel to dovetail surfaces 30 and 32. Handle 14 is frictionally secured to bracket 12 not only by mating dovetail surfaces, but also by a detent arrangement 38 inside recess 28 of bracket 12. Detent arrangement 38, which is seen in FIGS. 3 and 4, preferably is a hemispherical bump extending from recess 28 of bracket 12 and a mating dimple in the upper surface of bracket end 16 of handle 14. Detent arrangement 38 provides sufficient resistance to prevent handle 14 sliding out of bracket 12 inadvertently. However, detent arrangement 38 enables one to easily pull handle 14 from bracket 12 for sanitization.

In addition to detent arrangement 38, a hemispherical bump 35 may be added to bracket end 16 in order to limit the insertion of bracket end 16 into recess 28 of bracket 12, so that detent arrangement 38 is not overshot during handle to bracket assembly.

Figure 2:
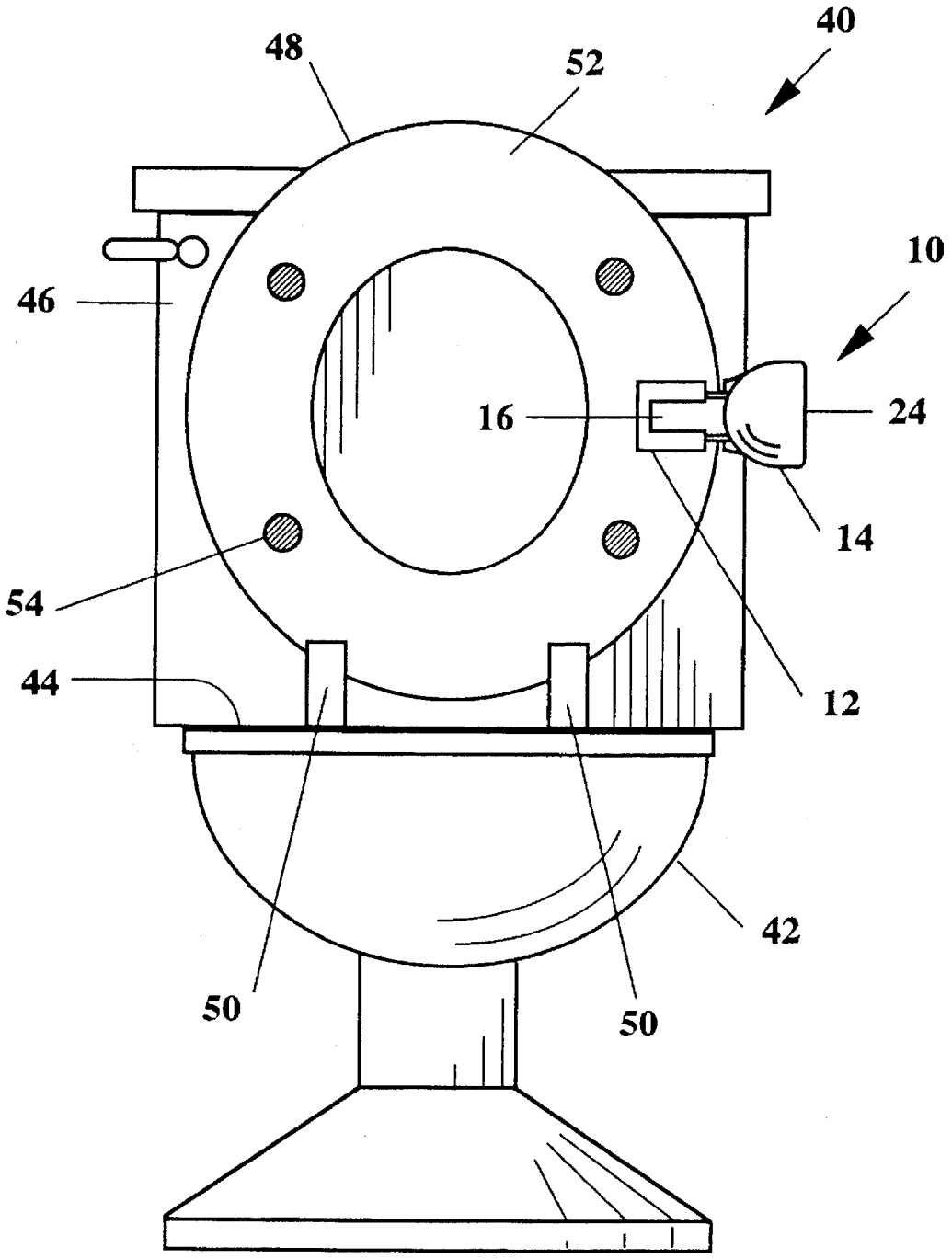
FIG. 2 is a front elevational view of a toilet, showing an upright toilet seat and the handle assembly of the present invention connected to the annular underside of the toilet seat.

FIG. 2 shows a conventional toilet, generally indicated as 40, which has a bowl 42, a bowl rim 44, and a water tank 46. Toilet 40 also has an annular toilet seat 48, which is hinged from bowl rim 44 by a pair of hinges 50. Seat 48 has two positions: horizontal for sitting thereon (not shown), and upright such that seat 48 rests against water tank 46. Seat 48 typically has a flat underside 52, which has a plurality of rubber or plastic bumper pads 54. Pads 54 space seat 46 away from bowl rim 44 when seat 48 is in its horizontal position.

Bracket 12 is preferably mounted to underside 52 of toilet seat 48. Connecting means 27 is placed against underside 52 and is connected thereto permanently When assembled to handle 14, bracket 12 may easily be located for mounting to toilet seat 48, shown in dotted line in FIG. 2, by a concave surface 29 at the rear of exterior 20 of handle 14. Concave surface 29 is shaped to roughly match the annular outermost edge of a toilet seat and is substantially perpendicular to upper surface 26 of bracket 12. Surface 26 may have a pocket for placement of double-sided tape 27 in order to minimize the overall thickness of bracket 12, which should be less than the thickness of bumper pads 54.

As shown in FIG. 2, bracket 12 is positioned such that handle 14 extends substantially radially from annular toilet seat 48. Finger opening 24 therefore faces outward from toilet bowl 44 regardless of the position of seat 48. Splash from toilet bowl 44 is shielded from inner surface 22 by modified paraboloid-shaped exterior surface 20. Handle assembly 10 can be mounted to either the right side or the left side of toilet seat 48.

FIG. 3 shows inner surface 22 having a shape paralleling that of exterior surface 20 such that a substantially uniform wall thickness exists between them. While this is preferable for molding purposes, the wall thickness may vary in order to provide exterior surface 20 with a decorative clamshell shape or a locating surface 29, for example, while inner surface 22 remains smooth for sanitization purposes. Edges of finger opening 24 are generously radiused. Opening 24 is preferably significantly larger than a user's finger so that one or more fingers may easily be inserted into opening 24 in order to press against inner surface 22 when lifting or lowering seat 48. Opening 24 also preferably has a dimension which is at least as great a depth dimension of inner surface 22, so that inner surface 22 is easy to access for cleaning. Although the modified paraboloid shape of inner surface 22 is preferred, it could also be hemispherical, or just about any other relatively smooth shape which gradually converges at the closed end. Avoidance of sharp edges and providing surface smoothness is also intended for child safety purposes.

FIG. 4 shows dovetail surfaces 30 and 32 at an angle 56 from a line perpendicular to surface 26. Angle 56 is designed to permit handle 14 to break away from bracket 12 if handle 14 is inadvertently struck by a downward blow when seat 48 is in a horizontal position. The break away feature is intended to protect both handle and bracket from damage, and it is intended as a child safety feature. Preferably, angle 56 is between 5° and 30°, depending upon the stiffness of the materials of bracket 12 and handle 14. Such stiffness is a function of material selection and the dimensions of these parts. At the rear end of bracket 12 is a support strap 37, which extends across the underside of bracket end 16. Support strap 37 is intended to prevent handle 14 from breaking away from bracket 12 when the handle is lifted with a jerk. However, support strap 37 does not interfere with handle 14 breaking away from bracket 12 when force from the opposite direction. Aiding breakaway is a cam surface 39 at the tip of bracket end 16. As dovetail surfaces disengage at the lifting end of handle 14, the tip of bracket end 16 rotates within support strap 37 on cam surface 39.

In a particularly preferred embodiment of the present invention, handle 14 and bracket 12 are injection molded of 72 Shore D polyurethane. Alternatively, one or both parts may be molded of polypropylene with talc or calcium carbonate added to increase stiffness.

Bracket 12 has an overall thickness of 8 mm, a width of 20 mm, and a length of 50 mm. Support strap 37 of bracket 12 is preferably 8 mm wide and 2 mm thick. In order for break away to occur under a reasonable downward blow, angle 56 is 30° when the bracket is made of polyurethane and the width of recess 28 is 15 mm and the depth of recess 28 is 6 mm. In the break away condition, surface 26 bows slightly to release bracket end 16 of handle 14 from the bracket dovetail surfaces. Preferably, bracket 12 is fastened to underside 52 of toilet seat 48 by 1 mm thick urethane foam double-sided tape, available from Minnesota Mining and Manufacturing Corp. of Minneapolis, Minn. This tape is preferably sized 40 mm by 20 mm to have a surface area sufficient to hold bracket 12 to seat 48 even under the force of a break away blow.

Preferably handle 14 has a smooth paraboloid-shaped inner surface 22 which is 30 mm deep, and at opening 24 is 65 mm wide and 25 mm high. Bracket end 16 is preferably 4 mm thick, 60 mm long, and 25 mm wide at its upper surface.

It is thought that the toilet seat lifting handle assembly of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof. For example, much of the benefit of the present invention could be achieved by permanently mounting handle 14 directly to a toilet seat or molding it as a part of the seat. Alternatively, significant benefit could also be obtained by removably attaching other lifting handle shapes using the dovetail bracket arrangement of the present invention.

What is claimed is:

1. A handle for lifting a toilet seat hinged to a toilet bowl, said handle comprising:

a) means for fastening a handle to a toilet seat; and b) a toilet seat lifting end opposite a toilet seat attachment end, said toilet seat lifting end having an exterior surface surrounding an inner surface, said exterior surface having a finger opening communicating with said inner surface, said finger opening facing outwardly from said toilet bowl when said toilet seat is in a substantially horizontal position, said finger opening being accessed by at least one of a user's fingers to lift and lower said toilet seat by pressing against said inner surface of said handle, said inner surface being shielded by said exterior surface from splashes created when one urinates into said toilet bowl and from aerosolized bacteria expelled from said toilet bowl when said toilet bowl is flushed, said toilet seat attachment adapted for fastening said handle to said toilet seat by said means for fastening, said finger opening having a dimension at least as large as a depth dimension of said inner surface, said inner surface having a smooth modified paraboloid shape which gradually converges from said finger opening toward said toilet seat attachment end of said handle, so that said inner surface can be easily cleaned from said finger opening of said handle, and said exterior surface of said toilet seat lifting end having a concave surface shaped to match an outermost edge of said toilet seat locating purposes.

2. The handle assembly of claim 1 wherein said means for fastening comprises a bracket permanently fastened to said toilet seat, said bracket having means for removable attachment of said handle, so that said handle may be removed from said bracket in order to sanitize said exterior and inner surfaces.

3. The handle assembly of claim 1 wherein said means for fastening comprises direct connection of said handle to said toilet seat.

4. The handle assembly of claim 1 wherein said means for fastening comprises molding said handle with said toilet seat.

5. A handle assembly for lifting a toilet seat hinged to a toilet bowl, said toilet seat having an underside and a range of positions from a substantially horizontal position to a substantially upright position, said handle assembly comprising:

a) a bracket fastened to said underside of said toilet seat; and b) a handle removably attached to said bracket, said handle having an exterior surface, an inner surface, a bracket end, and a lifting end, said lifting end having an outwardly facing finger opening communicating with said inner surface of said handle, said outwardly facing finger opening being accessed by at least one of a user's fingers in order to lift and lower said toilet seat by pressing against said inner surface of said handle, said inner surface being shielded by said exterior surface from splashes when one urinates into said toilet bowl with said toilet seat located anywhere within said range of positions, said inner surface also being shielded by said exterior surface from bacteria laden aerosolized toilet water spraying outward from said toilet bowl when said toilet bowl is flushed.

6. The handle assembly of claim 5 wherein said handle and said bracket have mating dovetail-shaped surfaces so that said handle is removable from said bracket without the use of tools, yet said handle is substantially fixed to said bracket when said handle is exposed to typical forces intended to lift and lower said toilet seat.

7. The handle assembly of claim 6 wherein said handle breaks away from said bracket without damage to said handle and said bracket when said handle is exposed to a downwardly directed blow when said toilet seat is in a substantially horizontal position.

8. A handle assembly for lifting a toilet seat hinged to a toilet bowl, said toilet seat having an underside and an annular outermost edge, said handle assembly comprising:

a) a handle having a lifting surface, and a dovetail-shaped bracket end; and b) a bracket fastened to said underside of said toilet seat, said bracket having a dovetail-shaped recess for mating with said bracket end such that said handle is removably attached to said bracket, said handle being easily removed without the use of tools for sanitization, yet said handle remaining affixed to said bracket in the presence of typical toilet seat lifting or lowering forces, said dovetail-shaped bracket end shaped to break away from said bracket without damage to said handle and said bracket when said handle is exposed to a downwardly directed blow when said toilet seat is in a substantially horizontal position.

9. The handle assembly of claim 8 wherein said handle has a concave locating surface which contacts said annular outermost edge of said toilet seat when said handle assembly is installed onto said toilet seat, said locating surface locating said bracket at said underside of said toilet seat for fastening thereto.

* * * * *